US010242626B2

(12) United States Patent
Lee et al.

(10) Patent No.: US 10,242,626 B2
(45) Date of Patent: Mar. 26, 2019

(54) STAGE AND ORGANIC LIGHT EMITTING DISPLAY DEVICE USING THE SAME

(71) Applicant: Samsung Display Co., Ltd., Yongin, Gyeonggi-Do (KR)

(72) Inventors: Hae-Yeon Lee, Yongin (KR); Yong-Jae Kim, Yongin (KR); Bo-Yong Chung, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 867 days.

(21) Appl. No.: 14/158,709

(22) Filed: Jan. 17, 2014

(65) Prior Publication Data

US 2015/0035732 A1 Feb. 5, 2015

(30) Foreign Application Priority Data

Aug. 1, 2013 (KR) ..... 10-2013-0091340

(51) Int. Cl.
*G09G 3/3266* (2016.01)

(52) U.S. Cl.
CPC ..... *G09G 3/3266* (2013.01)

(58) Field of Classification Search
CPC .. G09G 3/3266; G09G 3/3677; G09G 3/3216; G09G 2330/021; B60T 13/745; B60T 13/145
See application file for complete search history.

(56) References Cited

U.S. PATENT DOCUMENTS

2010/0188316 A1* 7/2010 Jang ..... 345/76
2011/0227883 A1 9/2011 Chung
2011/0227884 A1 9/2011 Chung
2013/0002306 A1 1/2013 Chung
2013/0002340 A1* 1/2013 Chung ..... H03K 17/687 327/434
2013/0002615 A1 1/2013 Kang et al.
2013/0002630 A1* 1/2013 Lee ..... G09G 3/3266 345/211
2013/0127805 A1* 5/2013 Chung ..... G09G 3/3266 345/211

FOREIGN PATENT DOCUMENTS

KR 10-2011-0104320 9/2011
KR 10-1065322 9/2011
KR 10-2013-0003248 1/2013
KR 10-2013-0003250 1/2013
KR 10-2013-0003251 1/2013

* cited by examiner

*Primary Examiner* — Mihir K Rayan

(74) *Attorney, Agent, or Firm* — Lewis Roca Rothgerber Christie LLP

(57) ABSTRACT

A stage includes an output unit configured to supply a scan signal to an output terminal according to voltages of first and second nodes; a first driver configured to control the voltages of the first and second nodes so that when a start signal or an output signal of a previous stage is supplied to a first input terminal, the scan signal is supplied from the output unit; and a second driver configured to control the voltages of the first and second nodes, corresponding to signals supplied to a second input terminal, a fourth input terminal and a fifth input terminal, wherein the second driver comprises eighth and ninth transistors coupled in series between the output terminal and the second node, and wherein a gate electrode of the eighth transistor is coupled to the first node, and a gate electrode of the ninth transistor is coupled to the fourth input terminal.

22 Claims, 7 Drawing Sheets

STAGE AND ORGANIC LIGHT EMITTING DISPLAY DEVICE USING THE SAME

CROSS-REFERENCE TO RELATED APPLICATION

This application claims priority to and the benefit of Korean Patent Application No. 10-2013-0091340, filed on Aug. 1, 2013, in the Korean Intellectual Property Office, the entire contents of which are incorporated herein by reference in their entirety.

BACKGROUND

1. Field

Embodiments of the present invention relate to a stage and an organic light emitting diode display device using the same.

2. Description of the Related Art

With the development of information technologies, the demand for display devices that operate as a connection medium for conveying information has increased. Accordingly, flat panel display devices (FPD devices) such as a liquid crystal display (LCD) device, an organic light emitting display device and a plasma display panel (PDP) are increasingly used.

Among these FPD devices, organic light emitting display devices display images using organic light emitting diodes (OLEDs) that emit light through recombination of electrons and holes. Organic light emitting display devices generally have a relatively fast response speed and are driven with relatively low power consumption, when compared with other types of FPD devices.

SUMMARY

Embodiments of the present invention provide a stage and an organic light emitting display device using the same, which are configured to supply scan signals in various orders.

According to an embodiment of the present invention, a stage includes: an output unit configured to supply a scan signal to an output terminal according to voltages of first and second nodes; a first driver configured to control the voltages of the first and second nodes so that when a start signal or an output signal of a previous stage is supplied to a first input terminal, the scan signal is supplied from the output unit; and a second driver configured to control the voltages of the first and second nodes, corresponding to signals supplied to a second input terminal, a fourth input terminal and a fifth input terminal, wherein the second driver includes eighth and ninth transistors coupled in series between the output terminal and the second node, and wherein a gate electrode of the eighth transistor is coupled to the first node, and a gate electrode of the ninth transistor is coupled to the fourth input terminal.

The output unit may include a first transistor between the fifth input terminal and the output terminal, the first transistor having a gate electrode coupled to the first node; a second transistor between the output terminal and the fourth input terminal, the second transistor having a gate electrode coupled to the second node; a first capacitor between the first node and the fifth input terminal; and a second capacitor between the second node and the output terminal.

The second driver may include a sixth transistor between the first node and the second input terminal, the sixth transistor having a gate electrode coupled to the second input terminal; and a seventh transistor between the second node and a first power source, the seventh transistor having a gate electrode coupled to the fifth input terminal.

The first power source may be set to a gate-off voltage.

Each of the sixth and seventh transistors may include a plurality of transistors coupled in series.

The first driver may include a third transistor between the first input terminal and the second node, the third transistor having a gate electrode coupled to a third input terminal; a fourth transistor between the fourth input terminal and the first node, the fourth transistor having a gate electrode coupled to the third input terminal; and a fifth transistor between the fourth transistor and the first node, the fifth transistor having a gate electrode coupled to the first input terminal.

Each of the third and fourth transistors may include a plurality of transistors coupled in series.

The first driver may include a third transistor between the first input terminal and the second node, the third transistor having a gate electrode coupled to a third input terminal; and a fourth transistor between the second input terminal and the first node, the fourth transistor having a gate electrode coupled to the second node.

According to an embodiment of the present invention, an organic light emitting diode display device includes: pixels in an area defined by scan lines and data lines; a data driver configured to supply data signals to the data lines; and a scan driver including stages respectively coupled to the scan lines so as to supply scan signals to the scan lines, wherein odd-numbered stages are configured to be driven by first signals and a control signal, and even-numbered stages are configured to be driven by second signals and the control signal.

Each stage may include a first input terminal configured to receive a start signal or an output signal of a previous stage; second, third, and fourth input terminals configured to receive the first or second signals; a fifth input terminal configured to receive the control signal; and an output terminal configured to output a corresponding one of the scan signals.

The first input terminals of a first stage and a second stage of the stages may be configured to receive the start signal.

The first input terminal of an odd-numbered stage of the stages may be configured to receive an output signal of a previous odd-numbered stage of the stages, and the first input terminal of an even-numbered stage of the stages may be configured to receive an output signal of a previous even-numbered stage of the stages.

Each of the first and second signals may include first, second, third, and fourth clock signals, and the first to fourth clock signals may be progressively supplied so that the voltage of the first to fourth clock signals are not overlapped at a low level with one another.

A k-th (k is 1, 2, 3 or 4) clock signal of the second signals may have a low level voltage that is overlapped with a low level voltage of a k-th clock signal of the first signals during at least one period.

The second, third, and fourth input terminals of an i-th (i is 1, 9, or a multiple of 9) stage and an (i+1)-th stage may be configured to receive the fourth, first, and second clock signals, respectively, the second, third, and fourth input terminals of an (i+2)-th stage and an (i+3)-th stage may be configured to receive the first, second, and third clock signals, respectively, the second, third and fourth input terminals of an (i+4)-th stage and an (i+5)-th stage may be configured to receive the second, third, and fourth clock signals, respectively, and the second, third, and fourth input terminals of an (i+6)-th stage and an (i+7)-th stage may be configured to receive the third, fourth, and first clock signals, respectively.

Each stage may include an output unit configured to supply a corresponding one of the scan signals to the output terminal, according to voltages of first and second nodes; and first and second drivers configured to control the voltages of the first and second nodes.

The output unit may include a first transistor between the fifth input terminal and the output terminal, the first transistor having a gate electrode coupled to the first node; a second transistor between the output terminal and the fourth input terminal, the second transistor having a gate electrode coupled to the second node; a first capacitor between the first node and the fifth input terminal; and a second capacitor between the second node and the output terminal.

The first driver may include a third transistor between the first input terminal and the second node; the third transistor having a gate electrode coupled to a third input terminal; a fourth transistor between the fourth input terminal and the first node, the fourth transistor having a gate electrode coupled to the third input terminal; and a fifth transistor between the fourth transistor and the first node, the fifth transistor having a gate electrode coupled to the first input terminal.

The start signal or the output signal of the previous stage, supplied to the first input terminal, may be overlapped with a clock signal supplied to the third input terminal.

The first driver may include a third transistor between the first input terminal and the second node, the third transistor having a gate electrode coupled to the third input terminal; and a fourth transistor between the second input terminal and the first node, the fourth transistor having a gate electrode coupled to the second node.

The start signal or the output signal of the previous stage, supplied to the first input terminal, may be overlapped with a clock signal supplied to the third input terminal.

The second driver may include a sixth transistor between the first node and the second input terminal, the sixth transistor having a gate electrode coupled to the second input terminal; a seventh transistor between the second node and a first power source, the seventh transistor having a gate electrode coupled to the fifth input terminal; and eighth and ninth transistors coupled in series between the output terminal and the second node. A gate electrode of the eighth transistor may be coupled to the first node, and a gate electrode of the ninth transistor may be coupled to the fourth input terminal.

The first power source may be set to a gate-off voltage.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
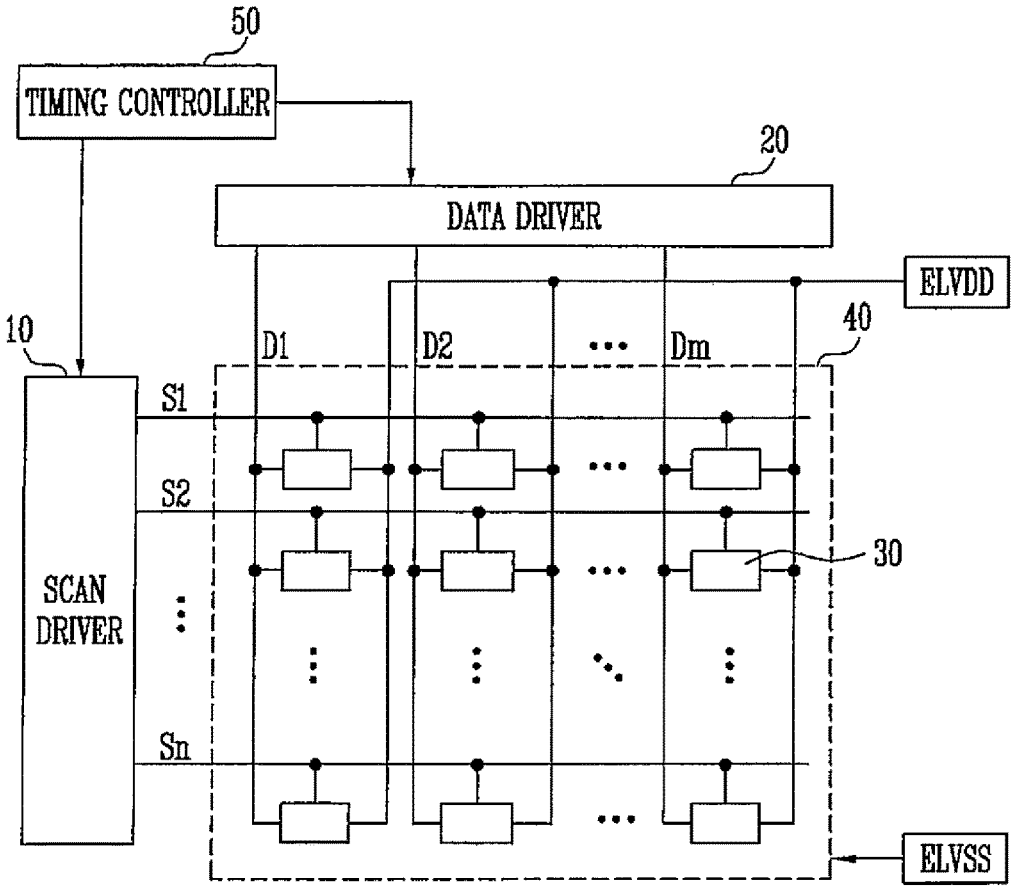
FIG. 1 is a diagram illustrating an organic light emitting display device according to an embodiment of the present invention.

Hereinafter, certain example embodiments according to the present invention will be described with reference to the accompanying drawings. Here, when a first element is described as being coupled to a second element, the first element may be not only directly coupled to the second element, but may also be indirectly coupled to the second element via a third element. Further, some of the elements that are not essential to the complete understanding of the invention are omitted for clarity. Also, like reference numerals refer to like elements throughout.

FIG. 1 is a diagram illustrating an organic light emitting display device according to an embodiment of the present invention.

Referring to FIG. 1, the organic light emitting display device according to this embodiment includes a pixel unit 40 including pixels 30 positioned at intersection portions of scan lines S1 to Sn and data lines D1 to Dm, a scan driver 10 configured to drive the scan lines S1 to Sn, a data driver 20 configured to drive data lines D1 to Dm, and a timing controller 50 configured to control the scan driver 10 and the data driver 20.

The scan driver 10 supplies scan signals to the scan lines S1 to Sn. The scan driver 10 may concurrently (e.g., simultaneously) or progressively supply the scan signal to the scan lines S1 to Sn. The scan driver 10 may supply scan signals to odd-numbered scan lines (e.g., S1, S3, . . . ) and even-numbered scan lines (e.g., S2, S4, . . . ) during different periods. To this end, the scan driver 10 may include stages (shown, e.g., in FIG. 2) respectively coupled to the scan lines S1 to Sn.

The data driver 20 supplies a data signal to the data lines D1 to Dm to be synchronized with the scan signal.

The timing controller 50 supplies control signals (not shown) for controlling the scan driver 10 and the data driver 20. The timing controller 50 supplies data (not shown) from the outside of the organic light emitting display device to the data driver 20.

The pixels 30 are selected when the scan signal is supplied, to charge a voltage corresponding to the data signal. Each of the selected pixels 30 generates light with a luminance (e.g., a predetermined luminance) while supplying, to an organic light emitting diode (not shown), current corresponding to the charged voltage.

Figure 2:
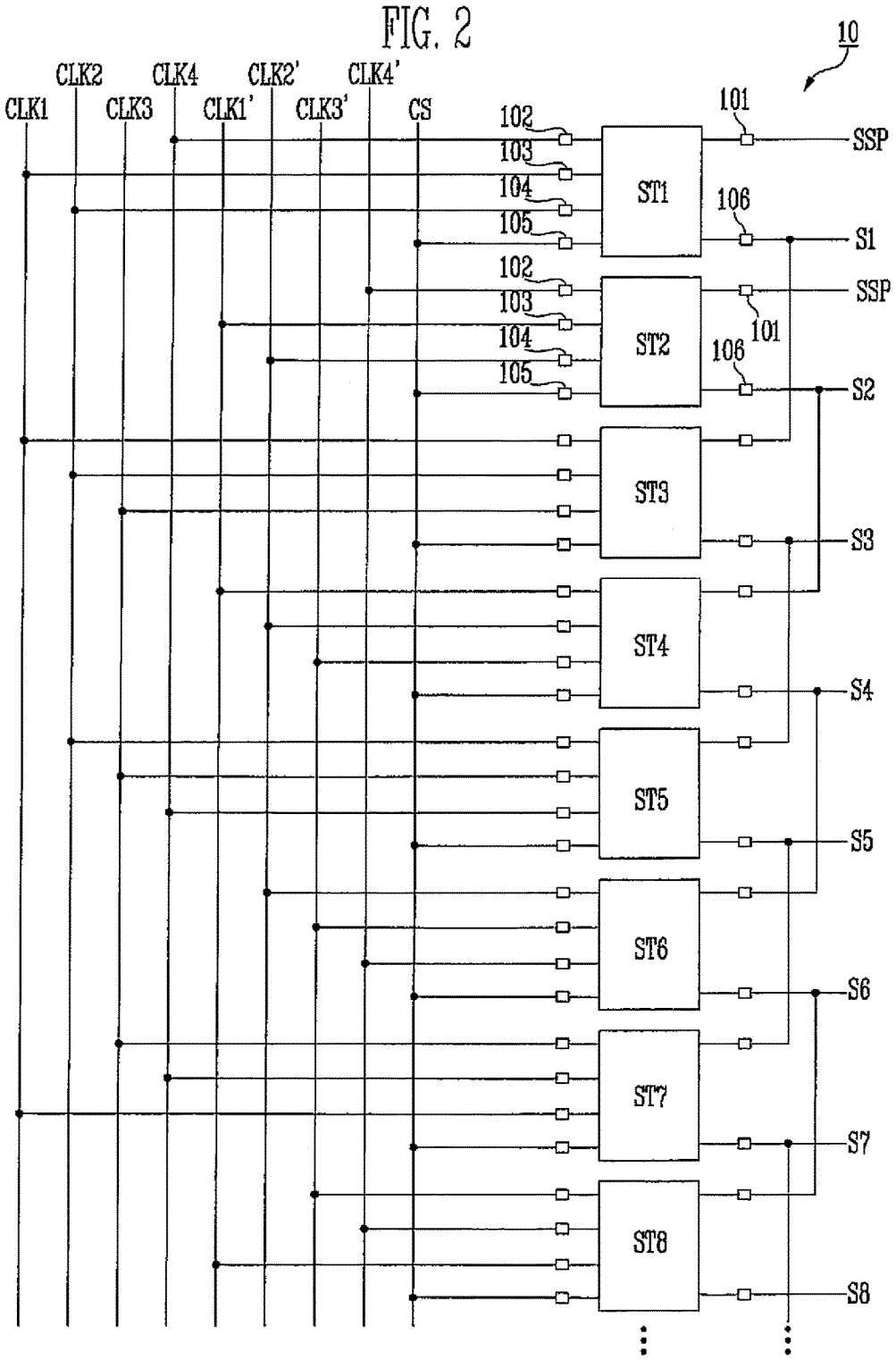
FIG. 2 is a diagram illustrating an embodiment of stages included in a scan driver.

FIG. 2 is a diagram illustrating an embodiment of stages included in a scan driver. For convenience of illustration, eight stages will be shown in FIG. 2, although the number of stages may vary according to the design and structure of the organic light emitting display device.

Referring to FIG. 2, the scan driver 10 according to this embodiment includes stages ST1 to ST8 respectively coupled to scan lines S1 to S8. Each of the stages ST1 to ST8 is coupled to any one of the scan lines S1 to S8. The stages ST1 to ST8 may be configured with the same circuit.

Odd-numbered (or even-numbered) stages (e.g., ST1, ST3, . . . ) are driven by first signals CKL1 to CLK4 and a control signal CS, and even-numbered (or odd-numbered) stages (e.g., S2, S4, . . . ) are driven by second signals CLK1' to CLK4' and the control signal CS. To this end, each of the stages ST1 to ST8 includes first to fifth input terminals 101 to 105 and an output terminal 106.

The first input terminal 101 included in each of the stages ST1 to ST8 receives a start signal SSP or an output signal (e.g., a scan signal) of the previous stage. For example, the first input terminals 101 of the first and second stages ST1 and ST2 receive the start signal SSP. Here, the start signal SSP is supplied to overlap with clock signals respectively supplied to the third input terminals 103 of the first and second stages ST1 and ST2. The first input terminal 101 of the odd-numbered (or even-numbered) stage receives a scan signal of the previous odd-numbered (or even-numbered) stage.

The second, third, and fourth input terminals 102, 103, and 104 of an i-th (i is 1, 9, or a multiple of 9) receive a fourth clock signal CLK4, a first clock signal CLK1, and a second clock signals CLK2, respectively.

The second, third, and fourth input terminals 102, 103, and 104 of an (i+1)-th stage receive a fourth clock signal CLK4', a first clock signal CLK', and a second clock signal CLK2', respectively.

The second, third, and fourth input terminals 102, 103 and 104 of an (i+2)-th stage receive the first clock signal CLK1, the second clock signal CLK2, and a third clock signal CLK3, respectively.

The second, third and fourth input terminals 102, 103, and 104 of an (i+3)-th stage receive the first clock signal CLK1', the second clock signal CLK2', and a third clock signal CLK3', respectively.

The second, third and fourth input terminals 102, 103, and 104 of an (i+4)-th stage receive the second clock signal CLK2, the third clock signal CLK3, and the fourth clock signal CLK4, respectively.

The second, third and fourth input terminals 102, 103, and 104 of an (i+5)-th stage receive the second clock signal CLK2', the third clock signal CLK3', and the fourth clock signal CLK4', respectively.

The second, third and fourth input terminals 102, 103, and 104 of an (i+6)-th stage receive the third clock signal CLK3, the fourth clock signal CLK4, and the first clock signal CLK1, respectively.

The second, third and fourth input terminals 102, 103, and 104 of an (i+7)-th stage receive the third clock signal CLK3', the fourth clock signal CLK4', and the first clock signal CLK1', respectively.

The first to fourth clock signals CLK1 to CLK4 included in the first signal are progressively supplied so that the phases of the first to fourth clock signals CLK1 to CLK4 are not overlapped with one another (i.e., so that the low levels of the first to fourth clock signals CLK1 to CLK4 are not overlapped with one another). For example, each of the first to fourth clock signals CLK1 to CLK4 may have a low level during a period of 2H. The first to fourth clock signals CLK1 to CLK4 may be progressively supplied so that the low levels of the first to fourth clock signals CLK1 to CLK4 are not overlapped with one another.

Similarly, the first to fourth clock signals CLK1' to CLK4' included in the second signal are progressively supplied so that the phases of the first to fourth clock signals CLK1' to CLK4' are not overlapped with one another. For example, each of the first to fourth clock signals CLK1' to CLK4' may have a low level during a period of 2H. The first to fourth clock signals CLK1' to CLK4' may be progressively supplied so that the low levels of the first to fourth clock signals CLK1' to CLK4' are not overlapped with one another. A k-th (k is 1, 2, 3, or 4) clock signal CLKk' included in the second signal may be supplied so that the low level of the k-th clock signal CLKk' is overlapped with that of a k-th clock signal CLKk included in the first signal during at least one period (e.g., a period of 1H).

Figure 3:
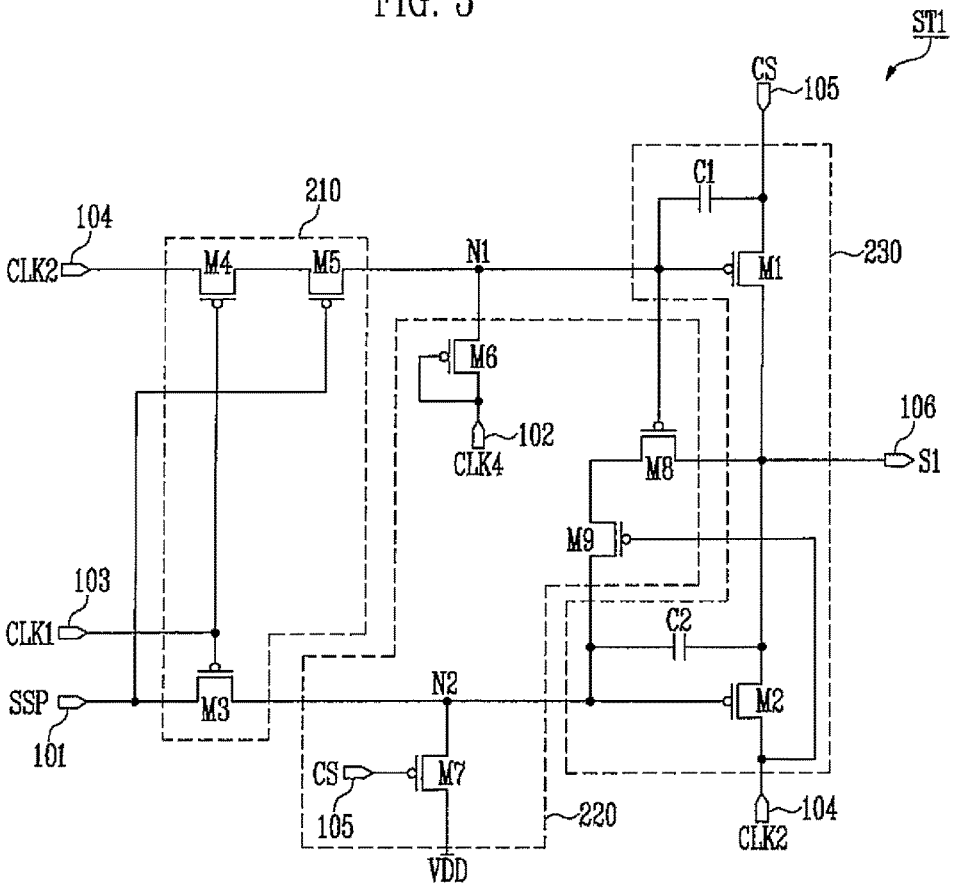
FIG. 3 is a circuit diagram illustrating an embodiment of the stage shown in FIG. 2.

FIG. 3 is a circuit diagram illustrating an example embodiment of one of the stages shown in FIG. 2. For convenience of illustration, the first stage ST1 will be shown in FIG. 3.

Referring to FIG. 3, the stage ST1 according to this embodiment includes a first driver 210, a second driver 220, and an output unit 230.

The output unit 230 controls a voltage supplied to the output terminal 106, corresponding to voltages of the first and second nodes N1 and N2. To this end, the output unit 230 includes a first transistor M1, a second transistor M2, a first capacitor C1, and a second capacitor C1.

The first transistor M1 is positioned between the fifth input terminal 105 and the output terminal 106. A gate electrode of the first transistor M1 is coupled to the first node N1. The first transistor M1 controls the coupling between the fifth input terminal 105 and the output terminal 106, corresponding to the voltage of the first node N1. Here, the fifth input terminal 105 is a terminal which receives a control signal CS, and maintains a high voltage (gate-off voltage) during a period in which the control signal CS is not supplied.

The second transistor M2 is positioned between the output terminal 106 and the fourth input terminal 104. A gate electrode of the second transistor M2 is coupled to the second node N2. The second transistor M2 controls the coupling between the output terminal 106 and the fourth input terminal 104, corresponding to the voltage of the second node N2.

The first capacitor C1 is coupled between the first node N1 and the fifth input terminal 105. The first capacitor C1 charges a voltage corresponding to the turn-on or turn-off of the first transistor M1.

The second capacitor C2 is coupled between the second node N2 and the output terminal 106. The second capacitor C2 charges a voltage corresponding to the turn-on or turn-off of the second transistor M2.

The first driver 210 controls the voltages of the first and second nodes N1 and N2, corresponding to signals supplied to the first, third and fourth input terminals 101, 103, and 104. For example, the first driver 210 controls the voltages of the first and second nodes N1 and N2 so that the scan signal can be supplied from the output unit 230 when the output signal (e.g., the scan signal) of the previous stage is input.

To this end, the first driver 210 includes a third transistor M3, a fourth transistor M4, and a fifth transistor M5.

The third transistor M3 is positioned between the first input terminal 101 and the second node N2. A gate electrode of the third transistor M3 is coupled to the third input terminal 103. The third transistor M3 is turned on when the first clock signal CLK1 is supplied to the third terminal 103, to allow the first input terminal 101 and the second node N2 to be electrically coupled to each other.

The fourth transistor M4 is positioned between the fourth input terminal 104 and the fifth transistor M5 (or the first node N1). A gate electrode of the fourth transistor M4 is coupled to the third input terminal. The fourth transistor M4 is turned on when the clock signal CLK1 is supplied to the third input terminal 103, to allow the fourth input terminal 104 and the fifth transistor M5 to be electrically coupled to each other.

The fifth transistor M5 is positioned between the fourth transistor M4 and the first node N1. A gate electrode of the fifth transistor M5 is coupled to the first input terminal 101. The fifth transistor M5 allows the fourth transistor M4 and the first node N1 to be electrically coupled to each other when the start signal SSP or the output signal of the previous stage is input to the first input terminal 101.

The second driver 220 controls the voltages of the first and second nodes N1 and N2, corresponding to signals supplied to the second, fourth and fifth input terminals 102, 104, and 105. To this end, the second driver 220 includes a sixth transistor M6, a seventh transistor M7, an eighth transistor M8, and a ninth transistor M9.

The sixth transistor M6 is positioned between the first node N1 and the second input terminal 102. A gate electrode of the sixth transistor M6 is coupled to the second input terminal 102. That is, the sixth transistor M6 is diode-coupled. The sixth transistor M6 is turned on when the clock signal CLK4 is supplied to the second input terminal 102.

The seventh transistor M7 is positioned between the second node N2 and a first power source VDD. A gate electrode of the seventh transistor M7 is coupled to the fifth input terminal 105. The seventh transistor M7 is turned on when the control signal CS is supplied to the fifth input terminal 105, to supply the voltage of the first power source VDD to the second node N2. Here, the first power source VDD is set to a high voltage (e.g., a gate-off voltage).

The eighth and ninth transistors M8 and M9 are coupled in series between the output terminal 106 and the second node N2. A gate electrode of the eighth transistor M8 is coupled to the first node N1, and a gate electrode of the ninth transistor M9 is coupled to the fourth input terminal 104. The eighth transistor M8 controls the electrical coupling between the output terminal 106 and the ninth transistor M9, corresponding to the voltage of the first node N1. The ninth transistor M9 controls the electrical coupling between the eighth transistor M8 and the second node N2, corresponding to the clock signal CLK2 supplied to the fourth input terminal 104.

Figure 4:
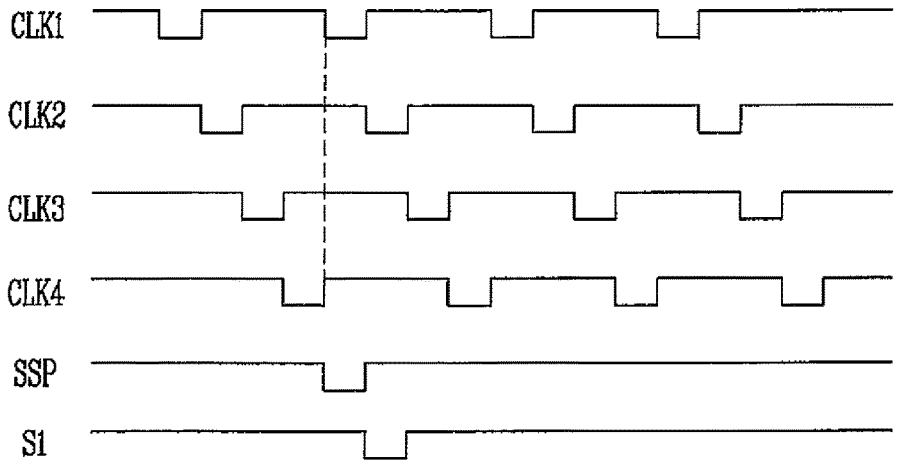
FIG. 4 is a waveform diagram illustrating a driving method of the stage shown in FIG. 3.

FIG. 4 is a waveform diagram illustrating a driving method of the stage shown in FIG. 3.

Referring to FIG. 4, the clock signals CLK1 to CLK4 are progressively supplied such that the low levels of the clock signals CLK1 to CLK4 are not overlapped with one another. The start signal SSP is supplied to the first input terminal 101 to overlap with the first clock signal CLK1 supplied to the third input terminal 103.

If the first clock signal CLK1 is supplied to the third input terminal 103, the third and fourth transistors M3 and M4 are turned on. If the start signal SSP is supplied to the first input terminal 101, the fifth transistor M5 is turned on.

If the third transistor M3 is turned on, the first input terminal 101 and the second node N2 are electrically coupled to each other. In this case, the second node N2 is set to a low voltage by the start signal SSP supplied to the first input terminal 101. If the second node N2 is set to the low voltage, the second transistor M2 is turned on.

If the second transistor M2 is turned on, the output terminal 106 and the second input terminal 104 are electrically coupled to each other. In this case, the fourth input terminal 104 is set to a high voltage (i.e., the second clock signal CLK2 is not supplied), and accordingly, the high voltage is also output to the output terminal 106 (i.e., the scan signal is not supplied).

Meanwhile, if the fourth and fifth transistors M4 and M5 are turned on, the fourth input terminal 104 and the first node N1 are electrically coupled to each other. In this case, the first node N1 receives the high voltage supplied from the fourth input terminal 104, and accordingly, the first transistor M1 is set to a turn-off state.

Subsequently, the second clock signal CLK2 is supplied to the fourth input terminal 104. In this case, the second transistor M2 is set to a turn-on state, corresponding to a voltage of the second capacitor C2, and hence the second clock signal CLK2 supplied to the fourth input terminal 104 is supplied to the output terminal 106. When the second clock signal CLK2 is supplied to the output terminal 106, the voltage of the second node N2 is dropped to a voltage lower than that of the second clock signal CLK2 by the coupling of the second capacitor C2, and accordingly, the second transistor M2 stably maintains the turn-on state. The second clock signal CLK2 supplied to the output terminal 106 is output as a scan signal to the scan line S1.

Meanwhile, if the second clock signal CLK2 is supplied to the fourth input terminal 104, the ninth transistor M9 is turned on. In this case, the eighth transistor M8 is set to the turn-off state, corresponding to the high voltage applied to the first node N1, and hence the second node N2 stably maintains the low voltage even though the ninth transistor M9 is turned on. Since the fourth transistor M4 is set to the turn-off state during the period in which the second clock signal CLK2 is supplied to the fourth input terminal 104, the voltage of the second clock signal CLK2 is not supplied to the first node N1. After the scan signal is supplied to the output terminal 106, the fourth clock signal CLK4 is supplied to the second input terminal 102. If the fourth clock signal CLK4 is supplied to the second input terminal 102, the sixth transistor M6 is turned on. If the sixth transistor M6 is turned on, the first node N1 is dropped to a low voltage by the fourth clock signal CLK4. If the first node N1 is set to the low voltage, the first transistor M1 is turned on. If the first transistor M1 is turned on, the high voltage from the fifth input terminal 105 is supplied to the output terminal 106.

Subsequently, the first clock signal CLK1 is supplied to the third input terminal 103 so that the third transistor M3 is turned on. If the third transistor M3 is turned on, the first input terminal 101 and the second node N2 are electrically coupled to each other. In this case, the start signal SSP is not supplied to the first input terminal 101, and hence the second node N2 is raised to the high voltage. If the second node N2 is set to the high voltage, the second transistor M2 is turned off.

Subsequently, the second clock signal CLK2 is supplied to the fourth input terminal 104 so that the ninth transistor M9 is turned on. In this case, the eighth transistor M8 is set to the turn-on state, corresponding to the voltage of the first node N1, and hence the output terminal 106 and the second node N2 are electrically coupled to each other, corresponding to the turn-on of the ninth transistor M9. In this case, the second node N2 receives the high voltage.

According to embodiments of the present invention, the scan signal is output to the output terminal 106 by repeating the aforementioned process. Whenever the fourth clock signal CLK4 is supplied during the period in which the scan signal is not output, the first node N1 is set to the low voltage, and the second node N2 is set to the high voltage, using the second clock signal CLK2. Then, the first and second nodes N1 and N2 are set to a voltage (e.g., a desired voltage), to improve reliability.

Figure 5:
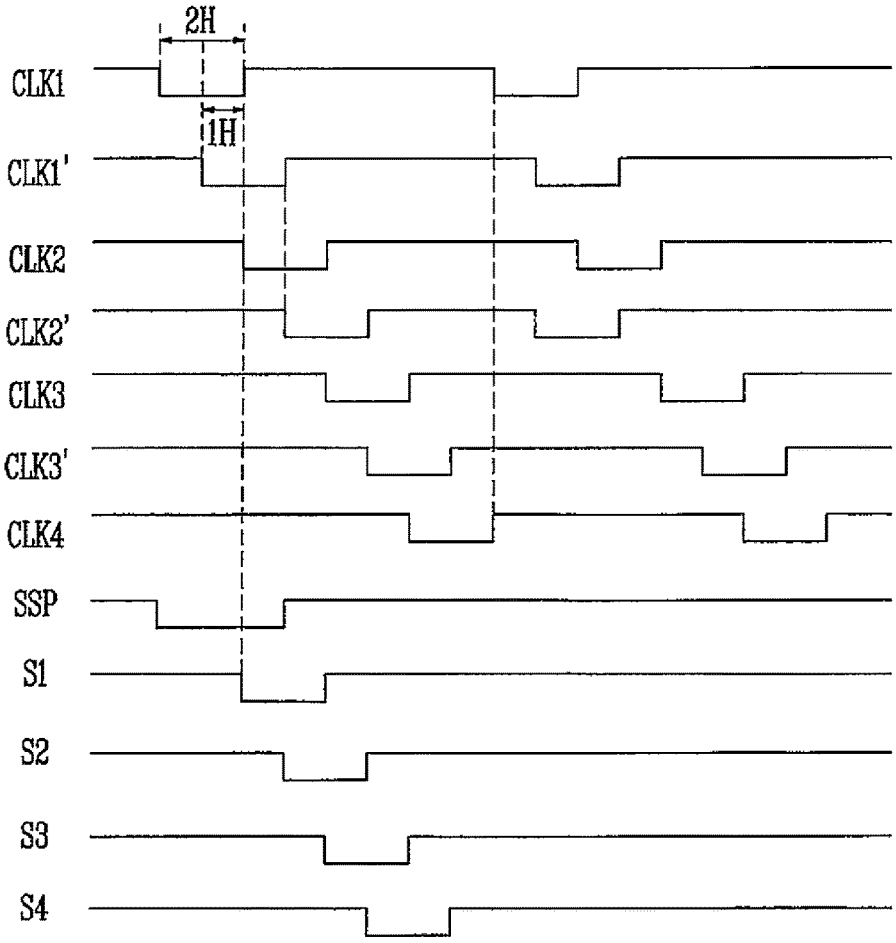
FIG. 5 is a waveform diagram illustrating an embodiment in which a scan signal is output corresponding to the driving method of FIG. 4.

FIG. 5 is a waveform diagram illustrating an embodiment in which a scan signal is output corresponding to the driving method of FIG. 4.

Referring to FIG. 5, the clock signals CLK1 to CLK4 included in the first signal are set to the voltage of the low level during two horizontal periods 2H. The clock signals CLK1 to CLK4 are sequentially supplied so that the voltages of the low levels of the clock signals CLK1 to CLK4 are not overlapped with one another. Similarly, the clock signals CLK1' to CLK4' included in the second signal are set to the voltage of the low level during two horizontal periods 2H. The clock signals CLK1' to CLK4' are sequentially supplied such that the voltages of the low levels of the clock signals CLK1' to CLK4' are not overlapped with one another. The k-th clock signal CLKk' included in the second signal is set so that the low level of the k-th clock signal CLKk' is overlapped with that of the k-th clock signal CLKk included in the first signal during one horizontal period 1H.

The start signal SSP is supplied to overlap with the first clock signal CLK1 supplied to the third input terminal 103 of the first stage ST1 and the first clock signal CLK1' supplied to the third input terminal of the second stage ST2.

In this case, the first stage ST1 outputs, to the first scan line S1, the second clock signal CLK2 supplied to the fourth input terminal 104 as a scan signal. The second stage ST2 outputs, to the second scan line S2, the second clock signal CLK2' supplied to the fourth input terminal 104 as a scan signal. The third stage ST3 outputs, to the third scan line S3, the third clock signal CLK3 supplied to the fourth input terminal 104 as a scan signal. The fourth stage ST4 outputs, to the fourth scan line S4, the third clock signal CLK3' supplied to the fourth input terminal 104 as a scan signal.

According to embodiments of the present invention, the scan signal can be supplied to the current scan line to overlap with the previous scan signal during a partial period while repeating the aforementioned process. Further, the clock signals CLK1' to CLK4' included in the second signal can be supplied to not overlap with the clock signals CLK1 to CLK4 including in the first signal. Then, the scan signal is progressively output so that the current scan signal is not overlapped with the previous scan signal.

As described above, according to embodiments of the present invention, the scan signal can be output in various manners while controlling the overlapping, width and the like of the clock signals CLK1 to CLK4 and CLK1' to CLK4'.

Figure 6:
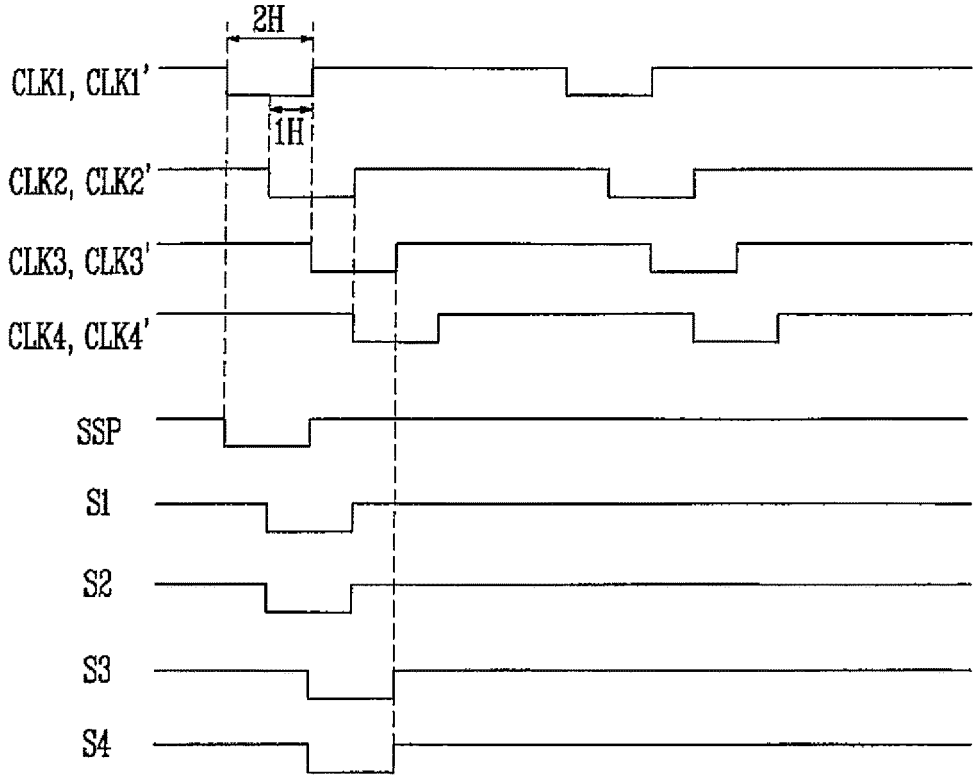
FIG. 6 is a waveform diagram illustrating another embodiment in which the scan signal is output corresponding to the driving method of FIG. 4.

FIG. 6 is a waveform diagram illustrating another embodiment in which the scan signal is output corresponding to the driving method of FIG. 4.

Referring to FIG. 6, the clock signals CLK1 to CLK4 included in the first signal are set to the voltage of the low level during two horizontal periods 2H. The clock signals CLK1 to CLK4 are progressively supplied so that the voltage of the low level of the previous clock signal is overlapped with that of the current clock signal during one horizontal period 1H. Similarly, the clock signals CLK1' to CLK4' included in the second signal are set to the voltage of the low level during two horizontal periods 2H. The clock signals CLK1' to CLK4' are progressively supplied so that the voltage of the low level of the previous clock signal is overlapped with that of the current clock signal during one horizontal period 1H. The k-th clock signal CLKk' included in the second signal is set so that the low level of the k-th clock signal CLKk' is overlapped with that of the k-th clock signal CLKk included in the first signal.

Then, the first and second stages ST1 and ST2 concurrently (e.g., simultaneously) supply a scan signal to the first and second scan lines S1 to Sn. Similarly, the third and fourth stages ST3 and ST4 concurrently (e.g., simultaneously) supply a scan signal to the third and fourth scan lines S3 and S4. Here, the scan signal supplied to the third scan line S3 is overlapped with that supplied to the first scan line S1 during a partial period (1H).

Figure 7:
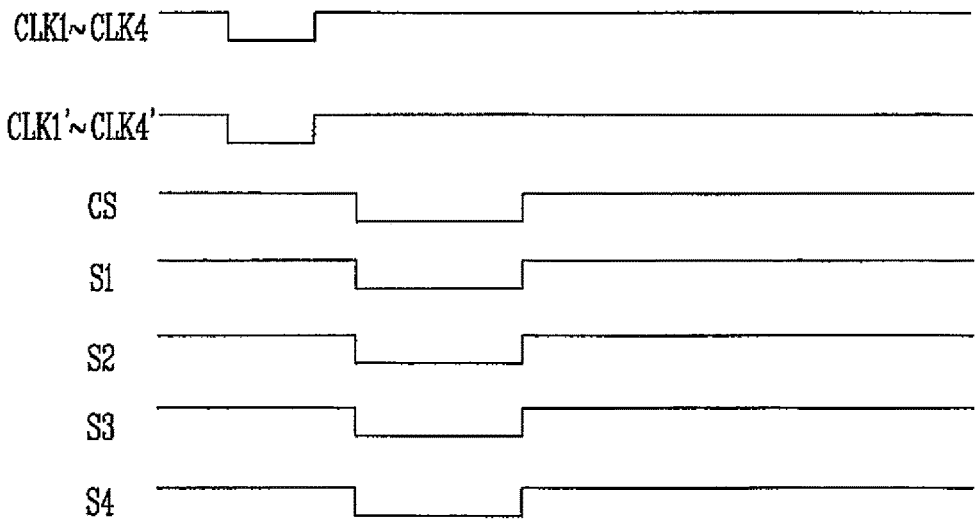
FIG. 7 is a waveform diagram illustrating a driving waveform for concurrently (e.g., simultaneously) supplying a scan signal to scan lines.

FIG. 7 is a waveform diagram illustrating a driving waveform for concurrently (e.g., simultaneously) supplying a scan signal to the scan lines.

The operating process of the stage will be described in conjunction with FIGS. 3 and 7. First, the clock signals CLK1 to CLK4 and CLK1' to CLK4' are concurrently (e.g., simultaneously) supplied. Then, the first node N1 is set to the low voltage, corresponding to the clock signal CLK4 supplied to the second input terminal 102. If the first node N1 is set to the low voltage, the first transistor M1 is turned on so that the output terminal 106 and the fifth input terminal 105 are electrically coupled to each other.

Subsequently, the control signal CS is supplied to the fifth input terminal 105. If the control signal CS is supplied to the fifth input terminal 105, the control signal CS is output to the output terminal 106. The output terminal 106 supplies, to the scan line S1, the control signal CS as a scan signal. Here, the control signal CS is commonly coupled to the fifth input terminals 105 of all the stages, and accordingly, the scan signal is concurrently (e.g., simultaneously) supplied to the scan lines S1 to Sn.

Meanwhile, when the control signal CS is supplied to the fifth input terminal 105, the voltage of the first node N1 is additionally dropped by the coupling of the first capacitor C1. Thus, the first transistor M1 stably maintains the turn-on state during the period in which the control signal CS is supplied.

If the control signal CS is supplied to the fifth input terminal 105, the seventh transistor M7 is turned on. If the seventh transistor M7 is turned on, the voltage of the first power source VDD is supplied to the second node N2. If the voltage of the first power source VDD is supplied to the second node N2, the second transistor M2 is set to the turn-off state.

Figure 8:
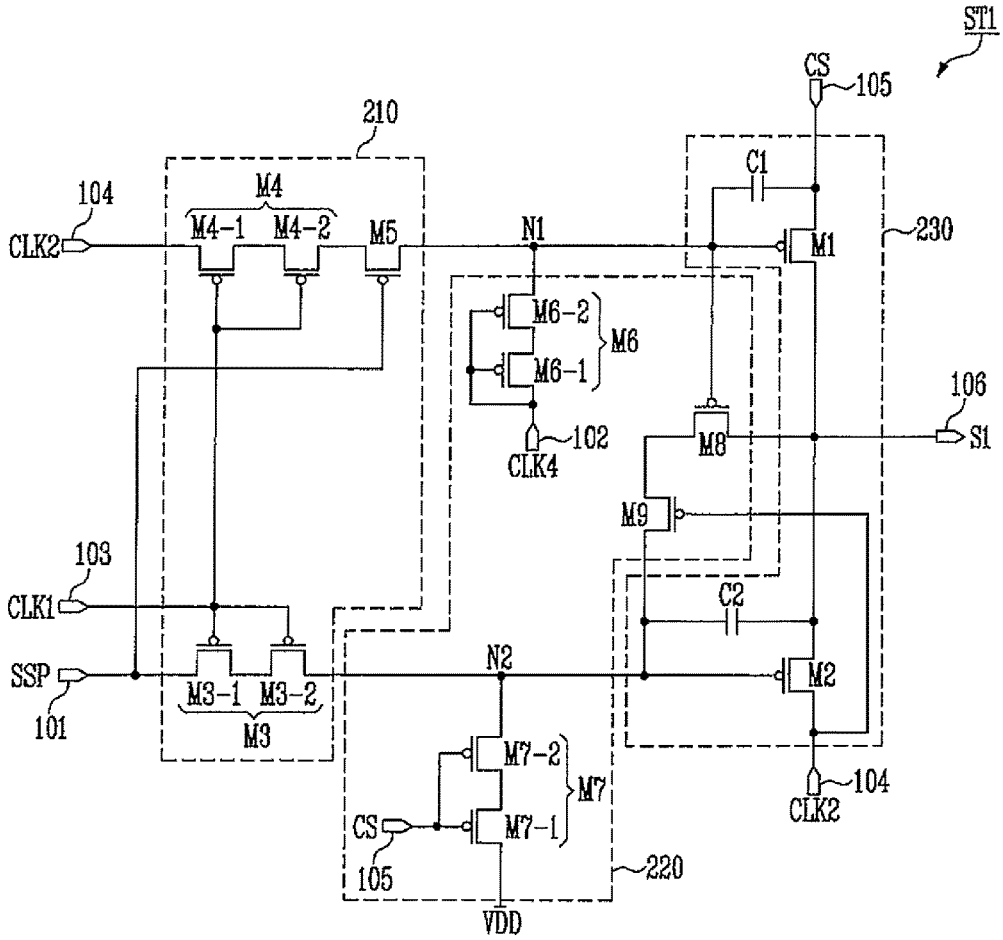
FIG. 8 is a circuit diagram illustrating another embodiment of the stage shown in FIG. 2.

FIG. 8 is a circuit diagram illustrating another embodiment of the stage shown in FIG. 2. In FIG. 8, components identical to those of FIG. 3 are designated by like reference numerals, and their detailed descriptions will be omitted.

Referring to FIG. 8, in this embodiment, each of the third, fourth, sixth, and seventh transistors M3, M4, M6, and M7 shown in FIG. 3 is configured with a plurality of transistors, and accordingly, it is possible to minimize leakage current.

More specifically, the third transistors M3 is configured with a plurality of transistors M3-1 and M3-2 coupled in series between the first input terminal 101 and the second node N2. Gate electrodes of the third transistors M3-1 and M3-2 are coupled to the third input terminal 103.

The fourth transistor M4 is configured with a plurality of transistors M4-1 and M4-2 coupled in series between the fourth input terminal 104 and the fifth transistor M5. Gate electrodes of the fourth transistors M4-1 and M4-2 are coupled to the third input terminal 103.

The sixth transistor M6 is configured with a plurality of transistors M6-1 and M6-2 coupled in series between the first node N1 and the second input terminal 102. Gate electrodes of the sixth transistors M6-1 and M6-2 are coupled to the second input terminal 102.

The seventh transistor M7 is configured with a plurality of transistors M7-1 and M7-2 coupled in series between the second node N2 and the first power source VDD. Gate electrodes of the seventh transistors M7-1 and M7-2 are coupled to the fifth input terminal 105.

The operating process of the stage according to this embodiment configured as described above is similar or substantially identical to that of the stage of FIG. 3, except that each of the third, fourth, sixth, and seventh transistors M3, M4, M6, and M7 is configured with a plurality of transistors. Therefore, its detailed description will be omitted.

Figure 9:
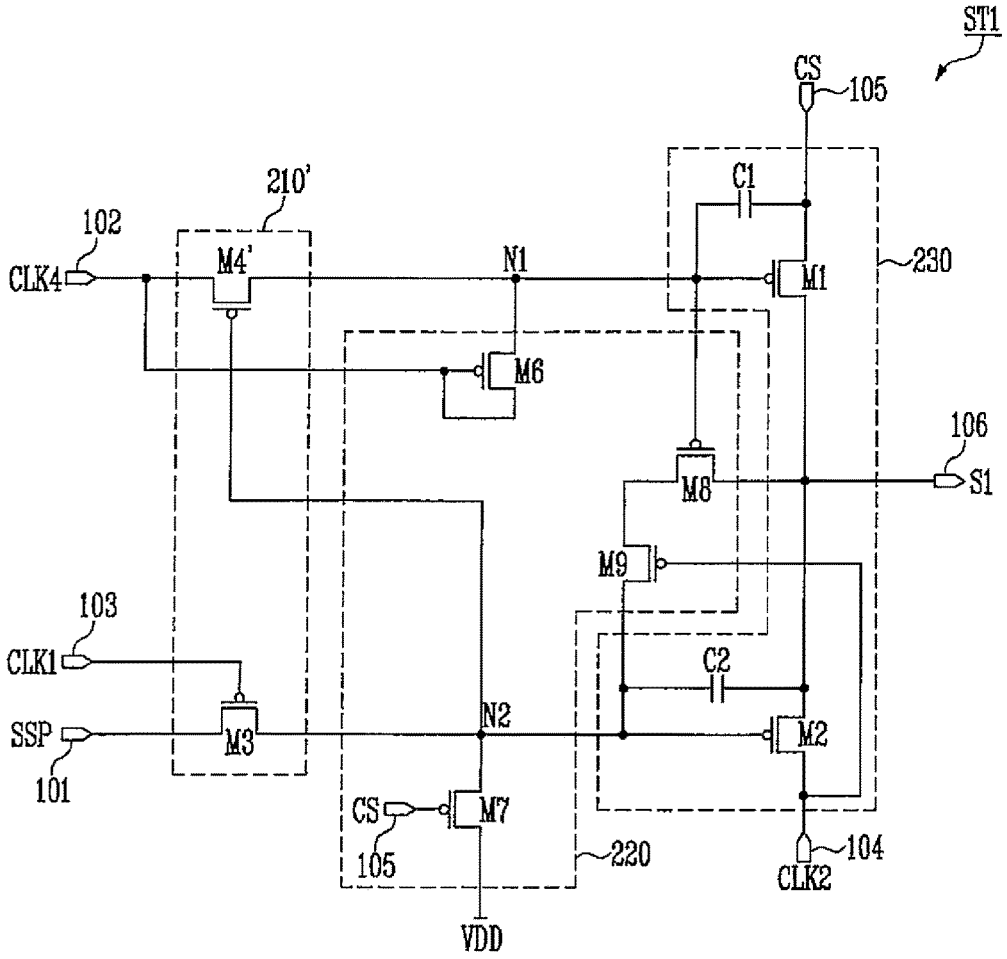
FIG. 9 is a circuit diagram illustrating still another embodiment of the stage shown in FIG. 2.

FIG. 9 is a circuit diagram illustrating still another embodiment of the stage shown in FIG. 2. In FIG. 9, components identical to those of FIG. 3 are designated by like reference numerals, and their detailed descriptions will be omitted.

Referring to FIG. 9, the stage ST1 according to this embodiment includes a first driver 210', the second driver 220 and an output unit 230. When comparing this embodiment with the embodiment of FIG. 3, the fifth transistor M5 is removed, and the coupling configuration of the fourth transistor M4 is changed.

A fourth transistor M4' included in the first driver 210' is positioned between the second input terminal 102 and the first node N1. A gate electrode of the fourth transistor M4' is coupled to the second node N2. The fourth transistor M4' controls the electrical coupling between the second input terminal 102 and the first node N1, corresponding to the voltage of the second node N2.

The operating process of the stage will be described in conjunction with FIGS. 4 and 9. First, the start signal SSP is supplied to the first input terminal 101 to overlap with the first clock signal CLK1 supplied to the third input terminal 103.

If the first clock signal CLK1 is supplied to the third input terminal 103, the third transistor M3 is turned on. If the third transistor M3 is turned on, the first input terminal 101 and the second node N2 are electrically coupled to each other. In this case, the second node N2 is set to the low voltage by the start signal SSP supplied to the first input terminal 101. If the second node N2 is set to the low voltage, the second and fourth transistors M2 and M4' are turned on.

If the second transistor M2 is turned on, the output terminal 106 and the fourth input terminal 104 are electrically coupled to each other. In this case, the fourth input terminal 104 is set to the high voltage, and accordingly, the high voltage is also output to the output terminal 106 (i.e., the scan signal is not supplied).

If the fourth transistor M4' is turned on, the high voltage of the fourth input terminal 104 is supplied to the first node N1. If the first node N1 is set to the high voltage, the first transistor M1 is turned off.

Subsequently, the second clock signal CLK2 is supplied to the fourth input terminal 104. The second clock signal CLK2 supplied to the fourth input terminal 104 is supplied to the output terminal 106 via the second transistor M2. The second clock signal CLK2 supplied to the output terminal 106 is output as a scan signal to the scan line S1.

Meanwhile, if the second clock signal CLK2 is supplied to the fourth input terminal 104, the ninth transistor M9 is turned on. In this case, the eighth transistor M8 is set to the turn-off state, corresponding to the high voltage applied to the first node N1, and hence the second node N2 stably maintains the low voltage even though the ninth transistor M9 is turned on.

After the scan signal is supplied to the output terminal 106, the fourth clock signal CLK4 is supplied to the second input terminal 102. If the fourth clock signal CLK4 is supplied to the second input terminal 102, the sixth transistor M6 is turned on. If the sixth transistor M6 is turned on, the first node N1 is dropped to the low voltage by the fourth clock signal CLK4. If the first node N1 is set to the low voltage, the first transistor M1 is turned on. If the first transistor M1 is turned on, the high voltage from the fifth input terminal 105 is supplied to the output terminal 106.

Subsequently, the first clock signal CLK1 is supplied to the third input terminal 103 so that the third transistor M3 is turned on. If the third transistor M3 is turned on, the first input terminal 101 and the second node N2 are electrically coupled to each other. In this case, the start signal SSP is not supplied to the first input terminal 101, and hence the second node N2 is raised to the high voltage. If the second node N2 is set to the high voltage, the second and fourth transistors M2 and M4' are turned off.

Subsequently, the second clock signal CLK2 is supplied to the fourth input terminal 104 so that the ninth transistor M9 is turned on. In this case, the eighth transistor M8 is set to the turn-on state, corresponding to the voltage of the first node N1, and hence the output terminal 106 and the second node N2 are electrically coupled to each other, corresponding to the turn-on of the ninth transistor M9. Here, the second node N2 receives the high voltage.

According to embodiments of the present invention, the scan signal is output to the output terminal 106 while repeating the aforementioned process.

Meanwhile, although it has been described with respect to example embodiments of the present invention that the transistors are shown as PMOS transistors for convenience of illustration, the present invention is not limited thereto. In other words, the transistors may be formed as NMOS transistors.

By way of summation and review, an organic light emitting display device includes a data driver configured to supply a data signal to data lines, a scan driver configured to progressively supply a scan signal to scan lines, and a pixel unit configured to include a plurality of pixels coupled to the scan lines and the data lines.

Pixels included in the pixel unit are selected when a scan signal is supplied to a scan line, to receive a data signal from a data line. The pixels receiving the data signal generate light with a luminance (e.g., a predetermined luminance) corresponding to the data signal, thereby displaying an image.

The organic light emitting display device is driven by various driving methods including a 3D driving method. For example, the organic light emitting display device may be driven by a dual view method in which observers each wearing shutter glasses view different images, using a fast response speed. Thus, a scan driver capable of supplying a scan signal is required to be applicable to various driving methods.

In the stage and the organic light emitting display device using the same according to embodiments of the present invention, scan signals can be supplied in various orders by controlling clock signals. That is, according to embodiments of the present invention, the scan signals can be progressively supplied or may be supplied to overlap with the previous scan signal during a period (e.g., a predetermined period). Further, the scan signal can be concurrently (e.g., simultaneously) supplied.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims, and their equivalents.

What is claimed is:

1. A stage comprising:

an output unit configured to supply a scan signal to an output terminal according to voltages of first and second nodes;

a first driver configured to control voltages of the first and second nodes so that when a start signal or an output signal of a previous stage is supplied to a first input terminal, the scan signal is supplied from the output unit; and a second driver configured to control the voltages of the first and second nodes, corresponding to signals supplied to a second input terminal, a fourth input terminal and a fifth input terminal, wherein the second driver comprises eighth and ninth transistors coupled in series between the output terminal and the second node, wherein a gate electrode of the eighth transistor is coupled to the first node, and a gate electrode of the ninth transistor is coupled to the fourth input terminal, and wherein the second driver further comprises a seventh transistor between the second node and a first power source, the seventh transistor having a gate electrode coupled to the fifth input terminal.

2. The stage of claim 1, wherein the output unit comprises:

a first transistor between the fifth input terminal and the output terminal, the first transistor having a gate electrode coupled to the first node;

a second transistor between the output terminal and the fourth input terminal, the second transistor having a gate electrode coupled to the second node;

a first capacitor between the first node and the fifth input terminal; and a second capacitor between the second node and the output terminal.

3. The stage of claim 1, wherein the second driver comprises:

a sixth transistor between the first node and the second input terminal, the sixth transistor having a gate electrode coupled to the second input terminal.

4. The stage of claim 3, wherein the first power source is set to a gate-off voltage.

5. The stage of claim 3, wherein each of the sixth and seventh transistors comprises a plurality of transistors coupled in series.

6. The stage of claim 1, wherein the first driver comprises:

a third transistor between the first input terminal and the second node, the third transistor having a gate electrode coupled to a third input terminal;

a fourth transistor between the fourth input terminal and the first node, the fourth transistor having a gate electrode coupled to the third input terminal; and a fifth transistor between the fourth transistor and the first node, the fifth transistor having a gate electrode coupled to the first input terminal.

7. The stage of claim 6, wherein each of the third and fourth transistors comprises a plurality of transistors coupled in series.

8. The stage of claim 1, wherein the first driver comprises:

a third transistor between the first input terminal and the second node, the third transistor having a gate electrode coupled to a third input terminal; and a fourth transistor between the second input terminal and the first node, the fourth transistor having a gate electrode coupled to the second node.

9. An organic light emitting display device, comprising:

pixels in an area defined by scan lines and data lines;

a data driver configured to supply data signals to the data lines; and a scan driver comprising stages respectively coupled to the scan lines so as to supply scan signals to the scan lines, wherein odd-numbered stages are configured to be driven by first signals and a control signal, and even-numbered stages are configured to be driven by second signals that are different from the first signals and the control signal, wherein each of the first and second signals comprises first, second, third, and fourth clock signals, and wherein the first to fourth clock signals are progressively supplied so that voltages of the first to fourth clock signals are not overlapped at a low level with one another.

10. The organic light emitting display device of claim 9, wherein a k-th (k is 1, 2, 3, or 4) clock signal of the second signals has a low level voltage that is overlapped with a low level voltage of a k-th clock signal of the first signals during at least one period.

11. The organic light emitting display device of claim 9, wherein the second, third, and fourth input terminals of an i-th (i is 1, 9, or a multiple of 9) stage and an (i+1)-th stage are configured to receive the fourth, first, and second clock signals, respectively, wherein the second, third, and fourth input terminals of an (i+2)-th stage and an (i+3)-th stage are configured to receive the first, second, and third clock signals, respectively, wherein the second, third and fourth input terminals of an (i+4)-th stage and an (i+5)-th stage are configured to receive the second, third, and fourth clock signals, respectively, and wherein the second, third and fourth input terminals of an (i+6)-th stage and an (i+7)-th stage are configured to receive the third, fourth, and first clock signals, respectively.

12. An organic light emitting display device, comprising:

pixels in an area defined by scan lines and data lines;

a data driver configured to supply data signals to the data lines; and a scan driver comprising stages respectively coupled to the scan lines so as to supply scan signals to the scan lines, wherein odd-numbered stages are configured to be driven by first signals and a control signal, and even-numbered stages are configured to be driven by second signals and the control signal, wherein each of the first and second signals comprises first, second, third, and fourth clock signals, wherein the first to fourth clock signals are progressively supplied so that voltages of the first to fourth clock signals are not overlapped at a low level with one another, and wherein each of the stages comprises:

a first input terminal configured to receive a start signal or an output signal of a previous stage;

second, third, and fourth input terminals configured to receive the first or second signals;

a fifth input terminal configured to receive the control signal; and an output terminal configured to output a corresponding one of the scan signals.

13. The organic light emitting display device of claim 12, wherein the first input terminal of each of a first stage and a second stage of the stages is configured to receive the start signal.

14. The organic light emitting display device of claim 13, wherein the first input terminal of an odd-numbered stage of the stages is configured to receive an output signal of a previous odd-numbered stage of the stages, and wherein the first input terminal of an even-numbered stage of the stages is configured to receive an output signal of a previous even-numbered stage of the stages.

15. The organic light emitting display device of claim 12, wherein each stage comprises:

an output unit configured to supply a corresponding one of the scan signals to the output terminal, according to voltages of first and second nodes; and first and second drivers configured to control voltages of the first and second nodes.

16. The organic light emitting display device of claim 15, wherein the output unit comprises:

a first transistor between the fifth input terminal and the output terminal, the first transistor having a gate electrode coupled to the first node;

a second transistor between the output terminal and the fourth input terminal, the second transistor having a gate electrode coupled to the second node;

a first capacitor between the first node and the fifth input terminal; and a second capacitor between the second node and the output terminal.

17. The organic light emitting display device of claim 15, wherein the first driver comprises:

a third transistor between the first input terminal and the second node, the third transistor having a gate electrode coupled to a third input terminal;

a fourth transistor between the fourth input terminal and the first node, the fourth transistor having a gate electrode coupled to the third input terminal; and a fifth transistor between the fourth transistor and the first node, the fifth transistor having a gate electrode coupled to the first input terminal.

18. The organic light emitting display device of claim 17, wherein the start signal or the output signal of the previous stage, supplied to the first input terminal, is overlapped with a clock signal supplied to the third input terminal.

19. The organic light emitting display device of claim 15, wherein the first driver comprises:

a third transistor between the first input terminal and the second node, the third transistor having a gate electrode coupled to the third input terminal; and a fourth transistor between the second input terminal and the first node, the fourth transistor having a gate electrode coupled to the second node.

20. The organic light emitting display device of claim 19, wherein the start signal or the output signal of the previous stage, supplied to the first input terminal, is overlapped with a clock signal supplied to the third input terminal.

21. The organic light emitting display device of claim 15, wherein the second driver comprises:

a sixth transistor between the first node and the second input terminal, the sixth transistor having a gate electrode coupled to the second input terminal;

a seventh transistor between the second node and a first power source, the seventh transistor having a gate electrode coupled to the fifth input terminal; and eighth and ninth transistors coupled in series between the output terminal and the second node, wherein a gate electrode of the eighth transistor is coupled to the first node, and a gate electrode of the ninth transistor is coupled to the fourth input terminal.

22. The organic light emitting display device of claim 21, wherein the first power source is set to a gate-off voltage.

* * * * *